US012359436B1

(12) United States Patent
Kimball

(10) Patent No.: US 12,359,436 B1
(45) Date of Patent: Jul. 15, 2025

(54) DECK FASCIA HANGERS

(71) Applicant: Colin Christopher Kimball, Dodge Center, MN (US)

(72) Inventor: Colin Christopher Kimball, Dodge Center, MN (US)

( * ) Notice: Subject to any disclaimer, the term of this patent is extended or adjusted under 35 U.S.C. 154(b) by 0 days.

(21) Appl. No.: 18/229,830

(22) Filed: Aug. 3, 2023

(51) Int. Cl.
*E04D 13/15* (2006.01)
*E04D 13/158* (2006.01)

(52) U.S. Cl.
CPC ..... *E04D 13/15* (2013.01); *E04D 13/158* (2013.01)

(58) Field of Classification Search
CPC ..... E04D 13/15; E04D 13/158; E04D 13/152; E04D 15/00; E04D 15/025; E04G 21/1841; E04F 21/1855
See application file for complete search history.

(56) References Cited

U.S. PATENT DOCUMENTS 2,770,271 A * 11/1956 Kane ..... E04G 21/1891 269/46
4,070,013 A * 1/1978 Sickler ..... E04F 21/1855 403/DIG. 7
4,836,517 A * 6/1989 Vossler ..... E04G 21/26 269/904
5,088,682 A * 2/1992 Gibbs ..... E04D 13/158 248/316.4
5,192,059 A * 3/1993 Silver ..... E04D 13/158 269/45
5,611,189 A * 3/1997 Fleck ..... E04D 13/158 52/93.2
5,746,421 A * 5/1998 Bowerman ..... E04G 21/16 269/41
6,318,711 B1 * 11/2001 Auston, Jr. ..... E04D 13/158 269/41
6,527,265 B1 * 3/2003 Goodding ..... E04F 21/1855 269/45
6,820,868 B1 * 11/2004 Reymus ..... E04F 21/1855 33/645
2024/0141661 A1 * 5/2024 Gurski ..... E04G 21/1841

* cited by examiner

*Primary Examiner* — Adriana Figueroa
(74) *Attorney, Agent, or Firm* — JOHNSON AND PHUNG; Thomas N. Phung

(57) ABSTRACT

A deck fascia hanging tool having a hanger main body with a first and second end, a supporting arm extending from the second end of the main body, a lip located proximal to a free end of the supporting arm, at least one locking member receiving slot located on an exterior surface of the main body, a rigid sleeve having a first and second end, an interior surface, and an outer deck frame engaging surface, a plurality of mounting tabs extending from the deck frame engaging the surface of the rigid sleeve and each supporting at least one fastener therethrough to secure the rigid sleeve to a surface of a deck frame, and a displaceable locking member extendable through a portion of the rigid sleeve and engageable with the locking member receiving slot to prevent the displacement of the elongated hanger main body with respect to the rigid sleeve.

20 Claims, 4 Drawing Sheets

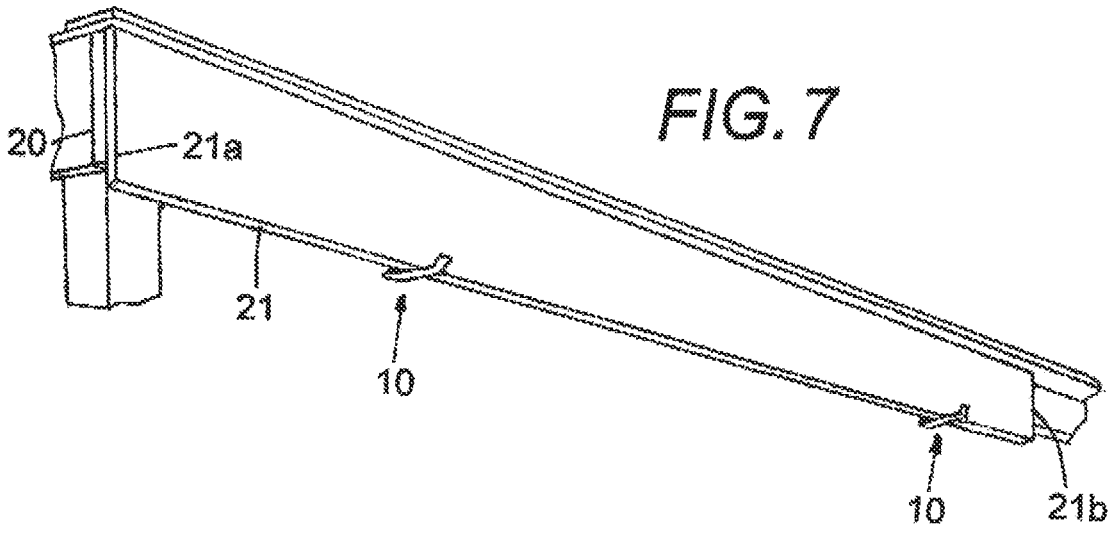
FIG. 7
FIG. 8
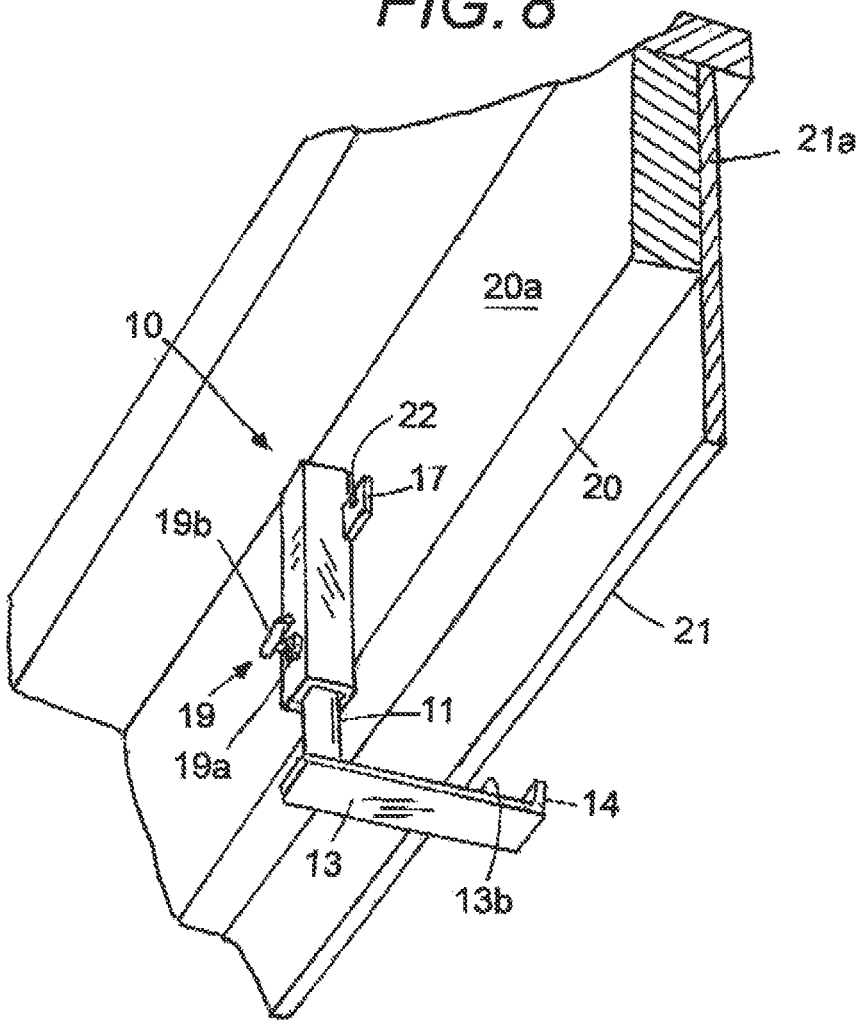

DECK FASCIA HANGERS

FIELD OF THE INVENTION

This invention relates generally to handheld tools and, more specifically to a deck fascia hanging tool.

CROSS-REFERENCE TO RELATED APPLICATIONS

None

STATEMENT REGARDING FEDERALLY SPONSORED RESEARCH OR DEVELOPMENT

None

REFERENCE TO A MICROFICHE APPENDIX

None

BACKGROUND OF THE INVENTION

A deck fascia board generally refers to a board of wood or other decking material that runs around the border of the deck. It is used to partially conceal the joists under a deck to create a polished look, elevating the overall visual appeal of your deck. It can also be used to create a stunning visual contrast if the user wishes to use a different color or stain for the deck fascia than for the deck. Fascia board provides other useful benefits in home construction. For example, when used under a home's roofline, fascia board can provide a stable mount for the home's gutters and seal off attic space from weather and animals.

Because deck fascia boards are typically long and heavy, with for example a piece of composite deck fascia board of 12 feet in length and 12 inches in width weighing roughly 60 pounds. In addition, deck fascia boards are often flexible and if not supported correctly, will buckle, bow, or possibly break. In view of the aforementioned, the installation of deck fascia boards generally requires at least two or more people to hold and align the deck fascia board against the border of the deck frame while another person secures the deck fascia board to the deck frame with fasteners.

The present invention is directed to solve the need for numerous people to install deck fascia boards to the deck frame by providing a deck fascia hanging tool that enables a deck builder to solely mount deck fascia boards to an outer frame of a residential or commercial deck.

SUMMARY OF THE INVENTION

Briefly, the present invention comprises a deck fascia hanging tool that includes an elongated hanger main body and a rigid sleeve. The elongated hanger main body includes a first free end and a second end, and a fascia board supporting arm extending from the second end of the elongated hanger main body in a perpendicular direction to the elongated hanger main body. Located proximal to a free end of the fascia board supporting arm, is a fascia board fenced-in lip which functions to prevent a fascia board from sliding off of the free end of the fascia board supporting arm. Extending from proximal the first end to proximal the second end of the elongated hanger main body is at least one elongated locking member receiving slot.

The rigid sleeve includes a first end, a second end, an interior surface supporting a portion of the elongated hanger main body therein, and an outer deck frame engaging surface. Extending from the deck frame engaging surface of the rigid sleeve in a parallel direction with the deck frame engaging surface is at least two deck frame mounting tabs with the deck frame mounting tabs each having a deck frame engaging surface and each supporting at least one fastener therethrough to temporarily secure the rigid sleeve to a surface of a deck frame. The rigid sleeve also includes a displaceable locking member extendable through a portion of the rigid sleeve and engageable with the locking member receiving slot to prevent the displacement of the elongated hanger main body with respect to the rigid sleeve.

The outer deck frame engaging surface of the rigid sleeve may include a first side and a second opposing side and the at least two deck frame mounting tabs may include a first deck frame mounting tab extending from the first side of the outer deck frame engaging surface proximal the first end of the rigid sleeve and a second deck frame mounting tab extending from the second side of the outer deck frame engaging surface proximal the second end of the rigid sleeve.

Alternative embodiments of the deck fascia hanging tool may include the displaceable locking member comprising a finger-operated locking bolt or a spring-loaded locking pin, the elongated hanger main body having a general circular-shaped cross-section, and the rigid sleeve having a square-shaped cross-section to enable swivel adjustment of the fascia board supporting arm with respect to the rigid sleeve, and a fascia board engaging surface of the fascia board supporting arm including a fascia board slip-resistant coating thereon, and the fascia board engaging surface having an adjustable length.

BRIEF DESCRIPTION OF THE DRAWINGS

FIG. 7 is a perspective view showing the use of a pair of deck fascia hanging tools supporting a fascia board;

FIG. 8 is a close-up perspective view showing one of the deck fascia hanging tool of FIG. 7;

DESCRIPTION OF THE PREFERRED EMBODIMENT

Figure 1:
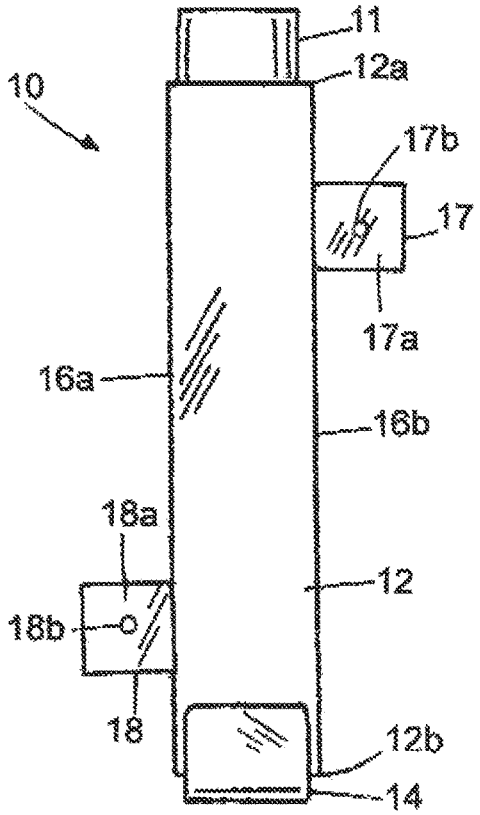
FIG. 1 is a front view of a deck fascia hanging tool of the present invention.

The general purpose of the present invention, which will be described subsequently in greater detail, is to provide a deck fascia hanging tool to assist a deck builder to solely install deck fascia boards to an outer frame of a residential or commercial deck.

There have thus been outlined the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods, and systems for carrying out the several purposes of the present invention. It is important, therefore, that the disclosing subject matter be regarded as including such equivalent constructions insofar as they do not depart from the spirit and scope of the present invention.

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary, or the following detailed description.

In addition, the accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of any potential claims.

Figure 2:
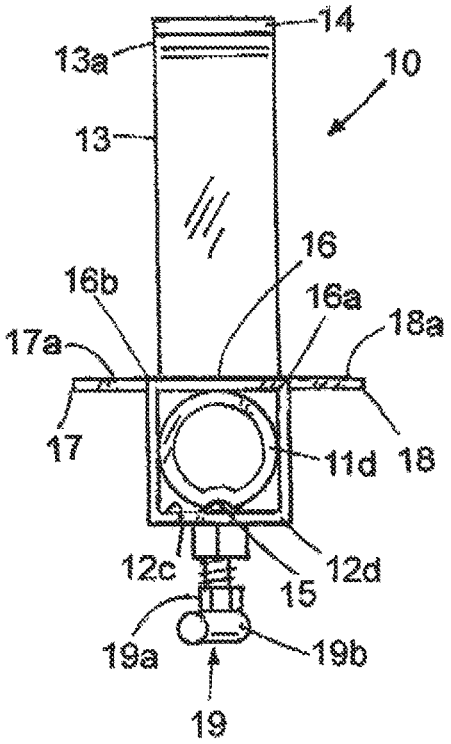
FIG. 2 is a top view of the deck fascia hanging tool of FIG. 1.
Figure 3:
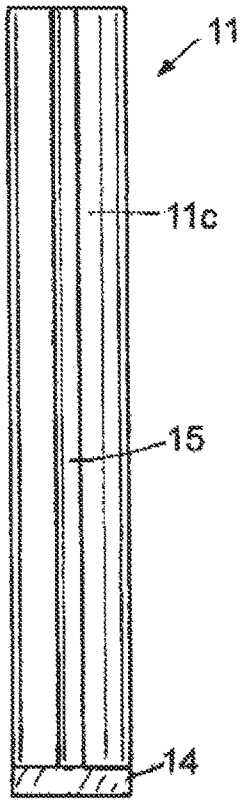
FIG. 3 is a front view of an elongated hanger main body of the deck fascia hanging tool of FIGS. 1 and 2.
Figure 4:
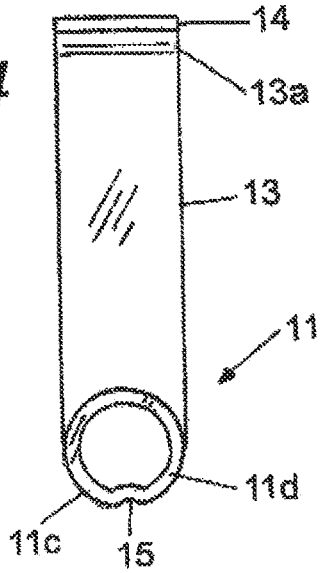
FIG. 4 is a top view of the elongated hanger main body of the deck fascia hanging tool of FIGS. 1 and 2.
Figure 5:
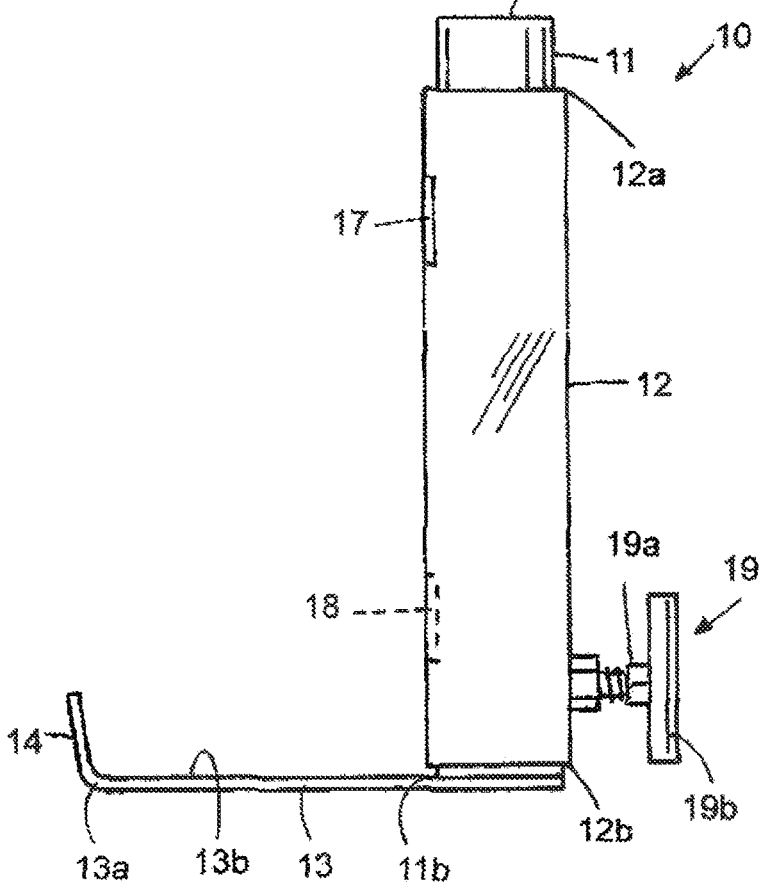
FIG. 5 is a side view showing the deck fascia hanging tool of FIG. 1 with the main arm body in a fully contracted condition.

Referring to the drawings, FIG. 1 is a front view, FIG. 2 is a top view showing an embodiment of a deck fascia hanging tool 10 of the present invention that is preferably weather-resistant and made from various types of material including but not limited to metal, hardened plastic, composite, and hardened rubber. Deck fascia hanging tool 10 generally includes an elongated hanger main body 11, and a rigid sleeve 12. FIG. 3 is a front view and FIG. 4 is a top view showing the elongated hanger main body 11 of the deck fascia hanging tool 10 of FIGS. 1 and 2.

Elongated hanger main body 11 generally includes a first free end 11*a* and a second end 11*b* and a general circular-shaped cross-section 11*d*. Extending from the second end 11*b* of the elongated hanger main body 11 in a perpendicular direction to the elongated hanger main body 11 is a fascia board supporting arm 13 having a free end 13*a*. Although the fascia board supporting arm may comprise various lengths, an example of a suitable length range may include but is not limited to between 2.24 inches to 4 inches.

Located proximal to the free end 13*a* of the fascia board supporting arm 13 is a fascia board fenced-in lip 14, which functions to prevent a deck fascia board 21 (shown in FIGS. 7 and 8) from sliding off of the free end 13*a* of the fascia board supporting arm 13. The elongated hanger main body 11 and the fascia board supporting arm 13 may be made from two separate pieces or a one-piece unit.

A feature of the present invention is that the elongated hanger main body 11 includes at least one locking member receiving slot located on an exterior surface 11*c* of the elongated banger main body 11. In the embodiment of FIGS. 1-4, the locking member receiving slot is shown as comprising an elongated locking member receiving slot 15 extending from proximal the first end 11*a* to proximal the second end 11*b* of the elongated hanger main body 11 and running parallel to the length of the elongated hanger main body 11.

The rigid sleeve 12 is shown in the embodiment of FIGS. 1-4 including a first end 12*a*, a second end 12*b*, an interior surface 12*c* supporting a portion of the elongated hanger main body 11 therein, a square-shaped cross-section 12*d*, and an outer deck frame engaging surface 16. Although the rigid sleeve 12 is may comprise various lengths, an example of a workable length may include but is not limited to the rigid sleeve 12 being 8 inches or less.

Providing the deck fascia hanging tool 10 with the elongated hanger main body 11 having the general circular-shaped cross-section 11*d* and the rigid sleeve 12 with the square-shaped cross-section 12*d* enables swivel adjustment of the fascia board supporting arm 13 with respect to the rigid sleeve 12 to provide greater adjustability to the deck fascia hanging tool 10 such as in corners.

A feature of the present invention is that the rigid sleeve 12 of the present invention includes at least two deck frame mounting tabs extending from the deck frame engaging surface 16 of the rigid sleeve 12 in a parallel direction with the deck frame engaging surface 16.

In the embodiment of FIGS. 1 and 2 the outer deck frame engaging surface 16 is shown having a first side 16*a* and a second opposing side 16*b* and the at least two deck frame mounting tabs includes a first deck frame mounting tab 17 extending from the first side 16*a* of the outer deck frame engaging surface 16 proximal the first end 12*a* of the rigid sleeve 12 and a second deck frame mounting tab 18 extending from the second side 116*b* of the outer deck frame engaging surface 16 proximal the second end 12*b* of the rigid sleeve 12.

The deck frame mounting tabs 17, 18 each include a deck frame engaging surface 17*a*, 18*a* and each having an orifice 17*b*, 18*b* for supporting at least one fastener such as but not limited to a screw or bolt therethrough to temporarily secure the rigid sleeve 12 to a surface of an outer deck frame 20.

The deck fascia hanging tool 10 of the present invention also includes a displaceable locking member extendable through a portion of the rigid sleeve 12 and engageable with the locking member receiving slot 15 to prevent the displacement of the elongated hanger main body 11 with respect to the rigid sleeve 12.

Although the displaceable locking member may comprise of various types of lockable members, in the embodiment of FIG. 2, the displaceable locking member is shown as comprising a finger-operated locking bolt 19 having a locking bolt 19*a* that may engage to or dis-engage from the locking member receiving slot 15 operations of a finger-engaging handle 19*b*.

Figure 6:
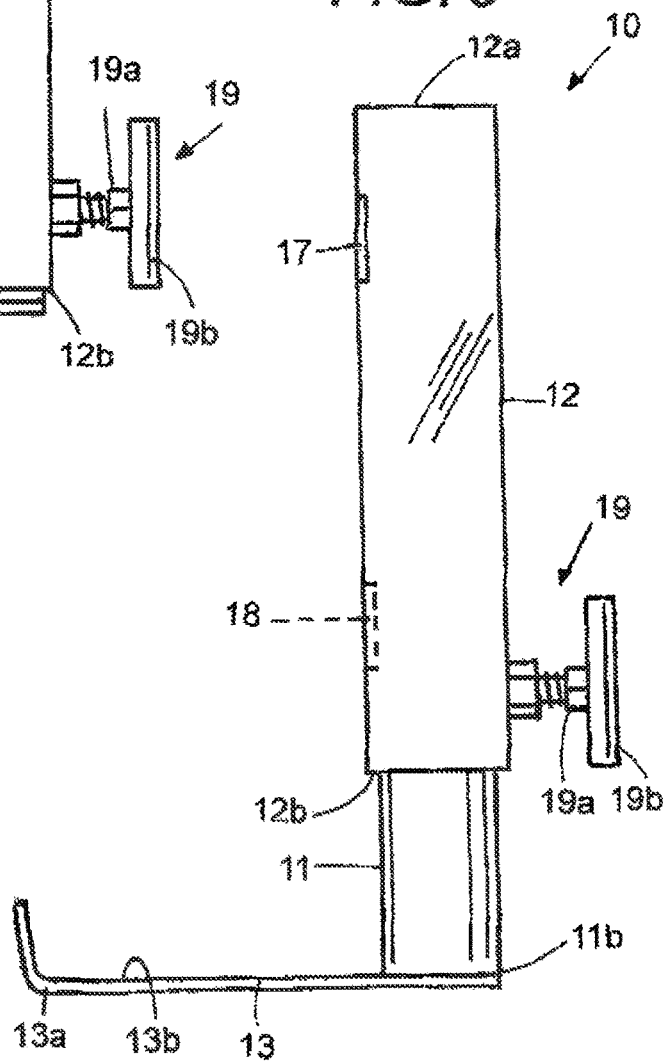
FIG. 6 is a side view showing the deck fascia hanging tool of FIG. 1 with the main arm body in a fully extended condition.

Referring to FIGS. 5-8, FIG. 5 is a side view showing the deck fascia hanging tool 10 with the main arm body 11 in a fully contracted condition identified by the main arm body 11 supported within the interior surface 12*c* of the rigid sleeve 12 with the fascia board supporting arm 13 lockingly located proximal to the second end 12*b* of the rigid sleeve 12. FIG. 6 is a side view showing the deck fascia hanging tool 10 with the main arm body 11 in a fully extended condition from the interior surface 12*c* of the rigid sleeve 12 identified by the main arm body 11 supported within the interior surface 12*c* of the rigid sleeve 12 with the fascia board supporting arm 13 lockingly located distal to the second end 12*b* of the rigid sleeve 12. It is noted that in the use of the deck fascia hanging tool 10 of the present invention, the fascia board supporting arm 13 may be adjusted to be lockingly positioned anywhere between distal and proximal the second end 12*b* of the rigid sleeve 12, depending on the requirement of the project.

FIG. 7 is a perspective view showing a pair of deck fascia hanging tools 10 in use with each deck fascia hanging tool 10 secured to an outer deck frame 20 and supporting a deck fascia board 21 proximal to the corresponding ends 21*a* and 21*b* of the deck fascia board 21.

FIG. 8 is a close-up perspective view showing one of the deck fascia hanging tool 10 of FIG. 7 in use in which the deck frame mounting tabs 17 and 18 (deck frame mounting tab 18*b* not shown) temporarily secure the rigid sleeve 12 to a surface 20*a* of outer deck frame 20 through the use of a fastener 22 with the fascia board positioned so it is flushed with a top of the deck boards.

The main arm body 11 is shown adjusted and lockingly positioned to enable the fascia board supporting arm 13 to support a portion of the deck fascia board 21 on a fascia board engaging surface 13*b* of the fascia board supporting arm 13. When in use, the deck fascia hanging tool 10 functions support the deck fascia board 21 to a surface of the outer deck frame 20 to assist the deck builder in solely mounting and securing the deck fascia board 21 to the outer deck frame 20 of a residential or commercial deck.

Figure 9:
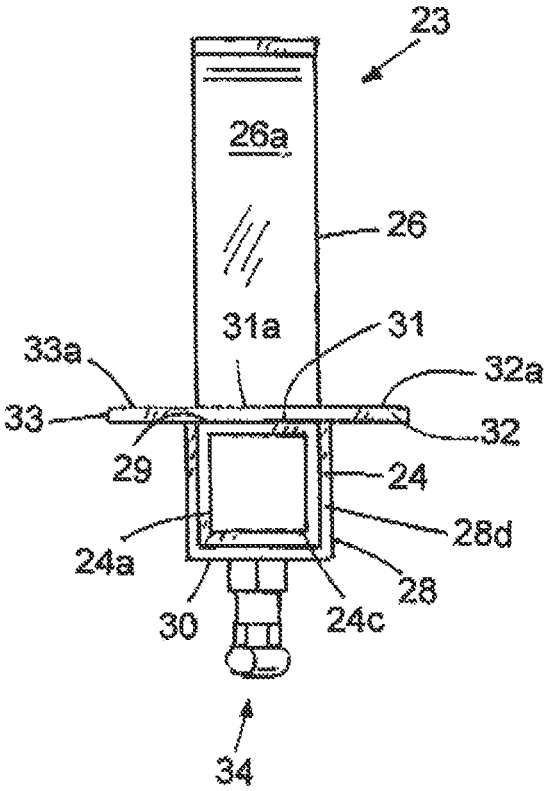
FIG. 9 is a top view showing an alternative embodiment of a deck fascia hanging tool of the present invention.
Figure 10:
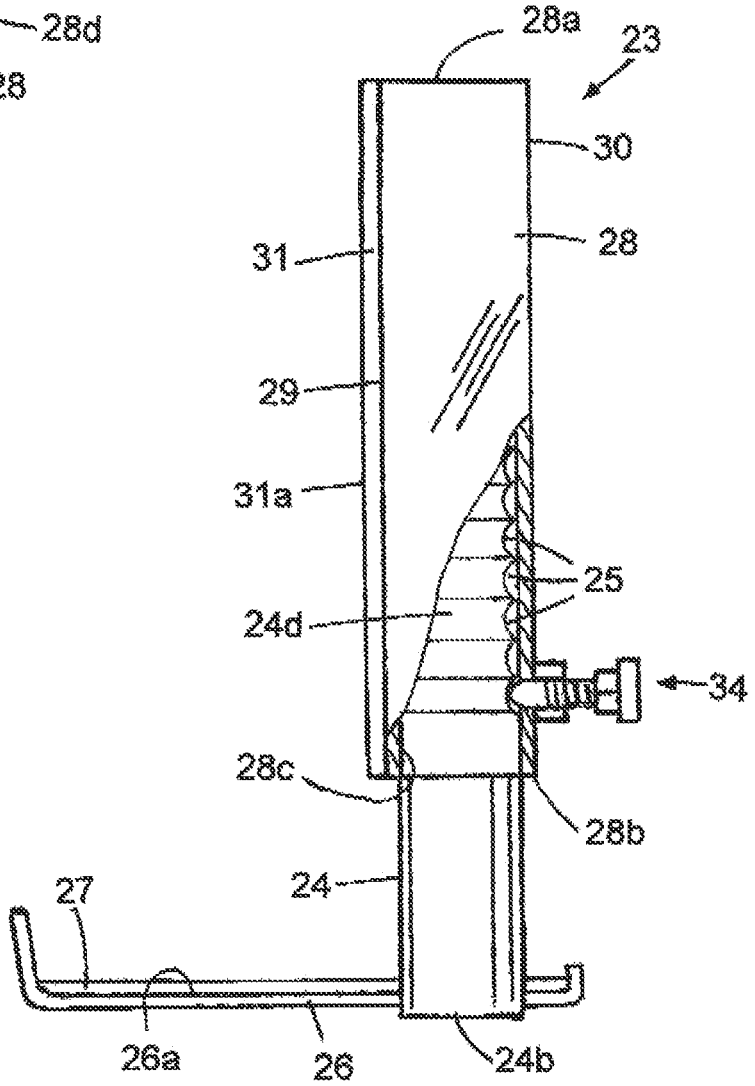
FIG. 10 is a partial cross-sectional side view showing the deck fascia hanging tool of the present FIG. 9.

Referring to FIGS. 9 and 10, FIG. 9 is a top view and FIG. 10 is a partial cross-sectional side view showing an alternative embodiment of a deck fascia hanging tool 23 of the present invention that includes similar parts to the deck fascia hanging tool 10 shown in FIGS. 1-8, namely an elongated hanger main body 23, and a rigid sleeve 28. However, the elongated hanger main body 24 includes a first free end 23*a*, a second end 23*b*, and a general square-shaped cross-section 24*c* instead of a circular-shaped cross-section.

Deck fascia hanging tool 23 includes a plurality of locking member receiving slots located on an exterior surface 24*d* of the elongated hanger main body 24 in a linear and spaced condition from each other between the first end 24*a* and the second end 24*b* of the elongated hanger main body 24 with the plurality of locking member receiving slots, as shown, comprising a plurality of elongated horizontal locking member receiving slots 25 each extending in a direction perpendicular to a length of the elongated hanger main body 24.

Deck fascia hanging tool 23 also includes a fascia board supporting arm 26 having an adjustable length extending from the second end 24*b* of the elongated hanger main body 24 in a perpendicular direction to the elongated hanger main body 24 and a fascia board engaging surface 26*a* to support a portion of the deck fascia board 21 thereon. In order to assist the support of the deck fascia board 21 on the fascia board supporting arm 26, the fascia board engaging surface 26*a* may optionally include a fascia board slip-resistant coating 27 thereon such as but not limited to a spray on slip-resistant rubber or polymer plastic coating.

The rigid sleeve 28 is shown in the embodiment of FIGS. 9-10 including a first end 28*a*, a second end 28*b*, an interior surface 28*c* supporting a portion of the elongated hanger main body 24 therein, a square-shaped cross-section 28*d*, a first deck frame mounting side 29 and an opposing second side 30. A feature of the deck fascia hanging tool 23 is that the rigid sleeve 28 includes a deck frame mounting plate 31 secured to the first deck frame mounting side 29 of the rigid sleeve 28 with the mounting plate 31 including a deck frame engaging surface 31*a*.

Extending from the deck frame mounting plate 31 in a parallel direction with the deck frame engaging surface 31*a* of the deck frame mounting plate 31 are at least two deck frame mounting tabs 32 and 33 with the deck frame mounting tabs 32, 33 each having a deck frame engaging surface 32*a*, 33*a* and each supporting at least one fastener therethrough to temporarily secure the rigid sleeve 28 to a surface of a deck frame 20.

Located on the second side 30 of the rigid sleeve 28 is a displaceable locking member comprising a spring-loaded locking pin 34 that is extendable through a portion of the rigid sleeve 28 and engageable with one of the elongated horizontal locking member receiving slots 25 to prevent the displacement of the elongated hanger main body 24 with respect to the rigid sleeve 28

I claim:

1. A deck fascia hanging tool comprising:

an elongated hanger main body having a first free end and a second end;

a fascia board supporting arm extending from the second end of the elongated hanger main body in a perpendicular direction to the elongated hanger main body;

a fascia board fenced-in lip located proximal to a free end of the fascia board supporting arm, the fascia board fenced-in lip preventing a fascia board from sliding off of the free end of the fascia board supporting arm;

at least one locking member receiving slot located on an exterior surface of the elongated hanger main body;

a rigid sleeve having a first end, a second end, an interior surface supporting a portion of the elongated hanger main body therein, and an outer deck frame engaging surface;

at least two deck frame mounting tabs extending from the outer deck frame engaging surface of the rigid sleeve in a parallel direction with the deck frame engaging surface, the at least two deck frame mounting tabs each having a deck frame engaging surface and each supporting at least one fastener therethrough to temporarily secure the rigid sleeve to a surface of a deck frame; and a displaceable locking member extendable through a portion of the rigid sleeve and engageable with the at least one locking member receiving slot to prevent the displacement of the elongated hanger main body with respect to the rigid sleeve.

2. The deck fascia hanging tool of claim 1 wherein the outer deck frame engaging surface includes a first side and a second opposing side and the at least two deck frame mounting tabs include a first deck frame mounting tab extending from the first side of the outer deck frame engaging surface proximal the first end of the rigid sleeve and a second deck frame mounting tab extending from the second side of the outer deck frame engaging surface proximal the second end of the rigid sleeve.

3. The deck fascia hanging tool of claim 1 wherein the at least one locking member receiving slot comprises an elongated locking member receiving slot extending from proximal the first end to proximal the second end of the elongated hanger main body.

4. The deck fascia hanging tool of claim 1 wherein the at least one locking member receiving slot comprises a plurality of slots located in a linear and spaced condition from each other between the first free end and the second end of the elongated hanger main body.

5. The deck fascia hanging tool of claim 2 wherein the plurality of slots comprises a plurality of elongated horizontal slots each extending in a direction perpendicular to a length of the elongated hanger main body.

6. The deck fascia hanging tool of claim 1 wherein the displaceable locking member comprises a finger-operated locking bolt.

7. The deck fascia hanging tool of claim 1 wherein the displaceable locking member comprises a spring-loaded locking pin.

8. The deck fascia hanging tool of claim 1 wherein the elongated hanger main body comprises a general circular-shaped cross-section and the rigid sleeve comprises a square-shaped cross-section.

9. The deck fascia hanging tool of claim 1 wherein the fascia board supporting arm includes a fascia board engaging surface having a fascia board slip-resistant coating thereon.

10. The deck fascia hanging tool of claim 1 wherein the fascia board supporting arm includes a fascia board engaging surface having an adjustable length.

11. A deck fascia hanging tool comprising:

an elongated hanger main body having a first free end and a second end;

a fascia board supporting arm extending from the second end of the elongated hanger main body in a perpendicular direction to the elongated hanger main body;

a fascia board fenced-in lip located proximal to a free end of the fascia board supporting arm, the fascia board fenced-in lip preventing a fascia board from sliding off of the free end of the fascia board supporting arm;

at least one elongated locking member receiving slot extending from proximal the first end to proximal the second end of the elongated hanger main body;

a rigid sleeve having a first end, a second end, an interior surface supporting a portion of the elongated hanger main body therein, and an outer deck frame engaging surface;

at least two deck frame mounting tabs extending from the outer deck frame engaging surface of the rigid sleeve in a parallel direction with the deck frame engaging surface, the at least two deck frame mounting tabs each having a deck frame engaging surface and each supporting at least one fastener therethrough to temporarily secure the rigid sleeve to a surface of a deck frame; and a displaceable locking member extendable through a portion of the rigid sleeve and engageable with the at least one locking member receiving slot to prevent the displacement of the elongated hanger main body with respect to the rigid sleeve.

12. The deck fascia hanging tool of claim 11 wherein the outer deck frame engaging surface includes a first side and a second opposing side and the at least two deck frame mounting tabs include a first deck frame mounting tab extending from the first side of the outer deck frame engaging surface proximal the first end of the rigid sleeve and a second deck frame mounting tab extending from the second side of the outer deck frame engaging surface proximal the second end of the rigid sleeve.

13. The deck fascia hanging tool of claim 12 wherein the displaceable locking member comprises a finger-operated locking bolt.

14. The deck fascia hanging tool of claim 13 wherein the elongated hanger main body comprises a general circular-shaped cross-section and the rigid sleeve comprises a square-shaped cross-section to enable swivel adjustment of the fascia board supporting arm with respect to the rigid sleeve.

15. The deck fascia hanging tool of claim 14 wherein the fascia board supporting arm includes a fascia board engaging surface having a fascia board slip-resistant coating thereon.

16. The deck fascia hanging tool of claim 15 wherein the fascia board supporting arm includes a fascia board engaging surface having an adjustable length.

17. A deck fascia hanging tool comprising:

an elongated hanger main body having a first free end and a second end;

a fascia board supporting arm extending from the second end of the elongated hanger main body in a perpendicular direction to the elongated hanger main body;

a fascia board fenced-in lip located proximal to a free end of the fascia board supporting arm, the fascia board fenced-in lip preventing a fascia board from sliding off of the free end of the fascia board supporting arm;

a plurality of elongated horizontal slots located on an exterior surface of the elongated hanger main body, the elongated horizontal slots each extending in a direction perpendicular to a length of the elongated hanger main body, the elongated horizontal slots positioned in a linear and spaced condition from each other between the first end and the second end of the elongated hanger main body;

a rigid sleeve having a first end, a second end, a square-shaped cross-section, a first deck frame mounting side and an opposing second side, and an interior surface supporting a portion of the elongated hanger main body therein, a deck frame mounting plate secured to the first deck frame mounting side of the rigid sleeve, the deck frame mounting plate including a deck frame engaging surface;

at least two deck frame mounting tabs extending from the deck frame mounting plate in a parallel direction with the deck frame engaging surface of the deck frame mounting plate, the at least two deck frame mounting tabs each having a deck frame engaging surface and each supporting at least one fastener therethrough to temporarily secure the rigid sleeve to a surface of a deck frame; and a displaceable locking member extendable through a portion of the rigid sleeve and engageable the plurality of elongated horizontal slots to prevent the displacement of the elongated hanger main body with respect to the rigid sleeve.

18. The deck fascia hanging tool of claim 17 wherein the fascia board supporting arm includes a fascia board engaging surface having an adjustable length.

19. The deck fascia hanging tool of claim 18 wherein the fascia board supporting arm includes a fascia board engaging surface having a fascia board slip-resistant coating thereon.

20. The deck fascia hanging tool of claim 19 wherein the displaceable locking member comprises a spring-loaded locking pin.

* * * * *